US008749456B2

(12) United States Patent
Wacyk et al.

(10) Patent No.: US 8,749,456 B2
(45) Date of Patent: Jun. 10, 2014

(54) METHOD OF DRIVING AN ORGANIC LIGHT EMITTING DIODE (OLED) PIXEL, A SYSTEM FOR DRIVING AN OLED PIXEL AND A COMPUTER-READABLE MEDIUM

(76) Inventors: Ihor Wacyk, Hopewell Junction, NY (US); Olivier Prache, Hopewell Junction, NY (US)

( * ) Notice: Subject to any disclaimer, the term of this patent is extended or adjusted under 35 U.S.C. 154(b) by 818 days.

(21) Appl. No.: 12/897,413

(22) Filed: Oct. 4, 2010

(65) Prior Publication Data

US 2011/0080441 A1 Apr. 7, 2011

Related U.S. Application Data

(60) Provisional application No. 61/278,302, filed on Oct. 5, 2009.

(51) Int. Cl.
*G09G 3/30* (2006.01)

(52) U.S. Cl.
USPC ..... 345/77; 345/76; 345/82; 315/169.3

(58) Field of Classification Search
USPC ..... 345/76–98; 315/149, 169.2–169.4
See application file for complete search history.

(56) References Cited

U.S. PATENT DOCUMENTS

| | | | | |
|---|---|---|---|---|
| 6,023,259 | A * | 2/2000 | Howard et al. | 345/76 |
| 6,064,357 | A * | 5/2000 | Okuda | 345/82 |
| 6,498,438 | B1 * | 12/2002 | Edwards | 315/169.3 |
| 2003/0132899 | A1 * | 7/2003 | Yamaguchi et al. | 345/76 |
| 2005/0162360 | A1 * | 7/2005 | Ishihara et al. | 345/89 |
| 2007/0200804 | A1 * | 8/2007 | Kwon | 345/76 |
| 2008/0136752 | A1 * | 6/2008 | Inoue et al. | 345/77 |

* cited by examiner

*Primary Examiner* — Gregory J Tryder
(74) *Attorney, Agent, or Firm* — Robert L. Epstein; Epstein Drangel LLP

(57) ABSTRACT

A new drive scheme is provided for OLED displays that uses a pulsed drive mode. The pulsed drive mode results in a reduced duty cycle for pixel operation. The peak OLED current is increased correspondingly to maintain a constant average luminance over the frame period so that there is no brightness loss. The method, system and computer-readable medium according to the present innovation uses a blanking signal to set the OLED pixel to black by discharging a capacitive element prior to re-programming the OLED pixel during a next synchronization cycle. An organic light emitting diode (OLED) pixel system is provided. A computer-readable medium having stored thereon computer-executable instructions is provided.

11 Claims, 4 Drawing Sheets

METHOD OF DRIVING AN ORGANIC LIGHT EMITTING DIODE (OLED) PIXEL, A SYSTEM FOR DRIVING AN OLED PIXEL AND A COMPUTER-READABLE MEDIUM

CROSS-REFERENCE TO RELATED APPLICATIONS

This application claims the benefit of U.S. Provisional Application No. 61/278,302 filed Oct. 5, 2009, which is incorporated herein by reference.

STATEMENT REGARDING FEDERALLY SPONSORED RESEARCH OR DEVELOPMENT

Not Applicable

BACKGROUND OF THE INVENTION

1. Field of the Invention

The present invention relates to organic light emitting diodes (OLEDs). In particular, the present invention relates to a pulse mode OLED pixel or sub-pixel driver.

2. Description of Prior Art

An OLED device typically includes a stack of thin layers formed on a substrate. A light-emitting layer of a luminescent organic solid, as well as adjacent semiconductor layers, are sandwiched between a cathode and an anode. The light-emitting layer may be selected from any of a multitude of fluorescent and phosphorescent organic solids. Any of the layers, and particularly the light-emitting layer, also referred to herein as the emissive layer or the organic emissive layer, may consist of multiple sublayers.

In a typical OLED display, either the cathode or the anode is transparent or semitransparent. The films may be formed by evaporation, spin casting, chemical self-assembly or any other appropriate polymer film-forming techniques. Thicknesses typically range from a few monolayers (i.e., a single, closely packed layer of atoms or molecules, perhaps as thin as one molecule), up to about 1000 to 2,000 angstroms.

Protection of an OLED display against oxygen and moisture can be achieved by encapsulation of the device. The encapsulation can be obtained by means of a single thin-film layer surrounding the OLED situated on the substrate.

High resolution active matrix displays may include millions of pixels and sub-pixels that are individually addressed by the drive electronics. The drive electronics for each sub-pixel can have several semiconductor transistors and other integrated circuit (IC) components. Each OLED may correspond to a pixel or a sub-pixel, and therefore these terms are used interchangeably hereinafter.

In an OLED device, one or more layers of semiconducting organic material are sandwiched between two electrodes. An electric current is applied across the device, causing negatively charged electrons to move into the organic material(s) from the cathode. Positive charges, typically referred to as holes, move in from the anode. The positive and negative charges meet in the center layers (i.e., the semiconducting organic material), combine, and produce photons. The wavelength—and consequently the color—of the photons depends on the electronic properties of the organic material in which the photons are generated.

The color of light emitted from the organic light emitting device can be controlled by the selection of the material used to form the emissive layer. White light may be produced by generating blue, red and green lights simultaneously. Other individual colors, different than red, green and blue, can be also used to produce in combination a white spectrum. The precise color of light emitted by a particular structure can be controlled both by selection of the organic material, as well as by selection of dopants in the organic emissive layers. Alternatively, filters of red, green or blue (or other colors), may be added on top of a white light emitting pixel. In further alternatives, white light emitting OLED pixels may be used in monochromatic displays.

Pixel drivers can be configured as either current sources or voltage sources to control the amount of light generated by the OLEDs in an active matrix display.

AMOLED displays are normally driven with constant luminance over a full frame cycle. A pixel is typically programmed once each frame period and the data is held constant by a storage capacitor (for analog pixels) or register (for digital pixels) until the next frame cycle when the pixel data is refreshed. This is known as a hold-type display in contrast to an impulse display like a cathode ray tube (CRT).

BRIEF SUMMARY OF THE INVENTION

A new drive scheme is provided for OLED displays that uses a pulsed drive mode. The pulsed drive mode results in a reduced duty cycle for pixel operation. The peak OLED current is increased correspondingly to maintain a constant average luminance over the frame period so that there is no brightness loss. The method, system and computer-readable medium according to the present innovation uses a blanking signal to set the OLED pixel to black by discharging a capacitive element prior to re-programming the OLED pixel during a next synchronization cycle.

A method is provided for driving an organic light emitting diode (OLED) pixel. The method includes receiving a first control signal corresponding to a first time duration and energizing the OLED pixel for a second time duration shorter than the first time duration. The method also includes setting the OLED pixel to black after the second time duration until an end of the first time duration.

In the method, the first control signal may define a first intensity level for the OLED pixel for the first time duration. The method may further includes transforming the first control signal into a drive signal having a second intensity level, the second intensity level being approximately equal to the first intensity level multiplied by the first time duration and divided by the second time duration.

The step of transforming may include providing a synchronization signal at a beginning of a cycle having the first time duration, and providing a ramp signal beginning at substantially a same time as the synchronization signal. The step of transforming may also include providing a second control signal for modulating the ramp signal and having a third time duration. The third time duration is based on the first intensity level of the first control signal. The second control signal may begin at substantially the same time as the synchronization signal. The drive signal may include the ramp signal when the second control signal is high, and, when the second control signal is low, the drive signal may be substantially constant at a value of the ramp signal at a transition of the second control signal from high to low.

The step of transforming may further include setting the drive signal to substantially zero with another synchronization signal after the second time duration.

In the method, the first control signal may be associated with a first frame period. The first frame period may be one of immediately consecutive frame periods, and each frame period may have a frame duration substantially identical to the first time duration. The synchronization signal may be periodic and a first number of the synchronization signals may occur during any frame period. The first number may be three or more. The OLED pixel may be set to black in response to a second one of the synchronization signals. The second one of the synchronization signals may follow the first one of the synchronization signals by a second number of synchronization signals. The second number may be less than the first number.

The setting of the drive signal to substantially zero may include discharging a capacitive element in a drive circuit that holds the drive signal.

The synchronization signal may be periodic and correspond to a horizontal synchronization signal, and the first time duration may include a frame in which the horizontal synchronization signal pulses once for each row in a display. The method may be performed for other OLED pixels in a same row as the OLED pixel using the synchronization signal.

The synchronization signal may be periodic and correspond to a vertical synchronization signal, and the first time duration may include a frame in which the vertical synchronization signal pulses once for each column in a display. The method may be performed for other OLED pixels in a same column as the OLED pixel using the synchronization signal.

The second intensity level may be approximately equal to between 5 and 10 times the first intensity, and the second time duration may be approximately equal to between 10 and 20 percent of the first time duration.

The first intensity level and the second intensity level may be measured in candela per square meter, and the first time duration and the second time duration may be measured in milliseconds.

An organic light emitting diode (OLED) pixel system is provided that is driven based on a first control signal defining a first intensity level for a first time duration. The system includes an arrangement for receiving the first control signal and an arrangement for transforming the first control signal into a drive signal having a second intensity level. The second intensity level is approximately equal to the first intensity level multiplied by the first time duration and divided by a second time duration. The second time duration is shorter than the first time duration. The system also includes an arrangement for energizing the OLED pixel for the second time duration based on the drive signal.

The OLED pixel system may include an arrangement for setting the OLED pixel to black during that portion of the first time duration that does not correspond to the second time duration.

In the OLED pixel system, the transforming arrangement may include an arrangement for providing a synchronization signal at a beginning of a cycle having the first time duration, and an arrangement for providing a ramp signal beginning at substantially the same time as the synchronization signal. The transforming arrangement may also include an arrangement for providing a second control signal for modulating the ramp signal and having a third time duration, the third time duration being based on the first intensity level of the first control signal. The second control signal may begin at substantially the same time as the synchronization signal. The drive signal may include the ramp signal when the second control signal is high, and, when the second control signal is low, the drive signal is substantially constant at a value of the ramp signal at a transition of the second control signal from high to low.

In the OLED pixel system, the transforming arrangement may further include an arrangement for setting the drive signal to substantially zero with another synchronization signal after the second time duration.

In the OLED pixel system, the setting of the drive signal to substantially zero may include discharging a capacitive element in a drive circuit that holds the drive signal.

A computer-readable medium having stored thereon computer-executable instructions is provided. The computer-executable instructions cause a processor to perform a method when executed. The method is for driving an organic light emitting diode (OLED) pixel based on a first control signal defining a first intensity level for a first time duration. The method includes receiving the first control signal and transforming the first control signal into a drive signal having a second intensity level. The second intensity level is approximately equal to the first intensity level multiplied by the first time duration and divided by a second time duration. The second time duration is shorter than the first time duration. The method also includes energizing the OLED pixel for the second time duration based on the drive signal.

DETAILED DESCRIPTION OF THE INVENTION

The pulse mode drive scheme provides a shortened active or "on" duration for the OLED pixel or sub-pixel, which may be controllable to be anything from 1 to 99% of the frame time. The minimum pulse duty may be limited by the peak current capability of the pixel drive circuit. In a Super Extended Graphics Array (SXGA) for example, the peak current may be limited by the voltage range of the CMOS drive circuit to about 5-10 times a nominal value. As a result, the pulse duty should not be less than 10-20% to keep the same average luminance.

The pulse mode drive scheme may offer several benefits over a standard continuous drive scheme. First, the pulse mode drive scheme may provide a fast motion response time. Motion blur artifacts on liquid crystal display (LCD) and OLED displays may primarily be a result of the hold-type displaying method used rather than response time (See T. Kurita, "Moving Picture Quality Improvement for Hold-Type AM-LCDs", 2001 SID Digest, pp. 986-989 (2001)). A conventional matrix display holds the image data for the entire duration of a frame until re-programmed at the start of the next frame. In contrast, a CRT display may have an impulse response in which the luminance decays very quickly within a small fraction of the frame period, and therefore the duty cycle over one frame period may be low. This may result in a smoother perceived image because the human eye may track the expected image motion better. By simulating a CRT response using a reduced pulse duration, the OLED motion response may provide a considerable improvement.

Second, the pulse mode drive scheme may provide a reduced storage capacitor requirement. A limitation to miniaturization of the pixel size may be the need for a large data storage capacitor within the pixel area. The storage capacitor may occupy more than 30% of the pixel area because it needs to hold the data over the long frame time without any substantial loss of signal. If the hold time is reduced by 80% for example, the storage capacitor can also be reduced, enabling a significant miniaturization in the pixel pitch without a loss of performance. This may provide a path to higher density arrays and/or smaller display size using the same silicon technology.

Third, the pulse mode drive scheme may provide an extended temperature operation. At higher temperatures, the parasitic leakage currents in a pixel driver may tend to discharge the storage capacitor faster than at room temperature or lower temperatures. This may result in a deterioration of image brightness and quality at high temperatures. By using the pulse mode drive scheme, the signal loss in the storage capacitor may be reduced within a frame time, and therefore the display may be able to perform to a higher temperature specification.

Figure 1:
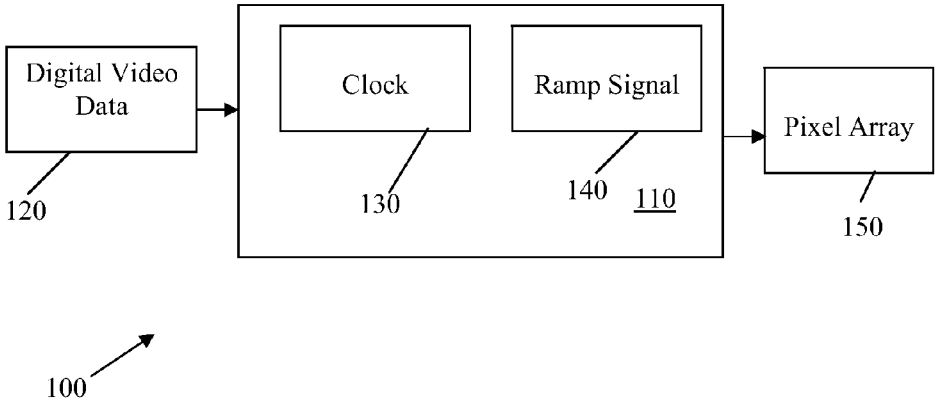
FIG. 1 is a schematic diagram of an OLED pixel drive system in accordance with an exemplary embodiment.

FIG. 1 illustrates schematically OLED pixel array system 100. OLED pixel array system 100 includes OLED controller 110 which receives digital video data 120. OLED controller 110 includes clock 130 and ramp 140 used to process digital video data 120. OLED controller 110 processes digital video data 120 into an analog signal that is used to drive pixel array 150. Pixel array 150 may be driven in any manner, and in particular may be driven row by row until an entire frame has been written. When each row is written, each OLED pixel or sub-pixel in the corresponding row may be independently driven by OLED controller 110. Pixel drivers can be configured as either current sources or voltage sources to control the amount of light generated by the OLEDs in an active matrix display. Therefore, pixel array 150 may be driven by a voltage or a current.

Figure 2A:
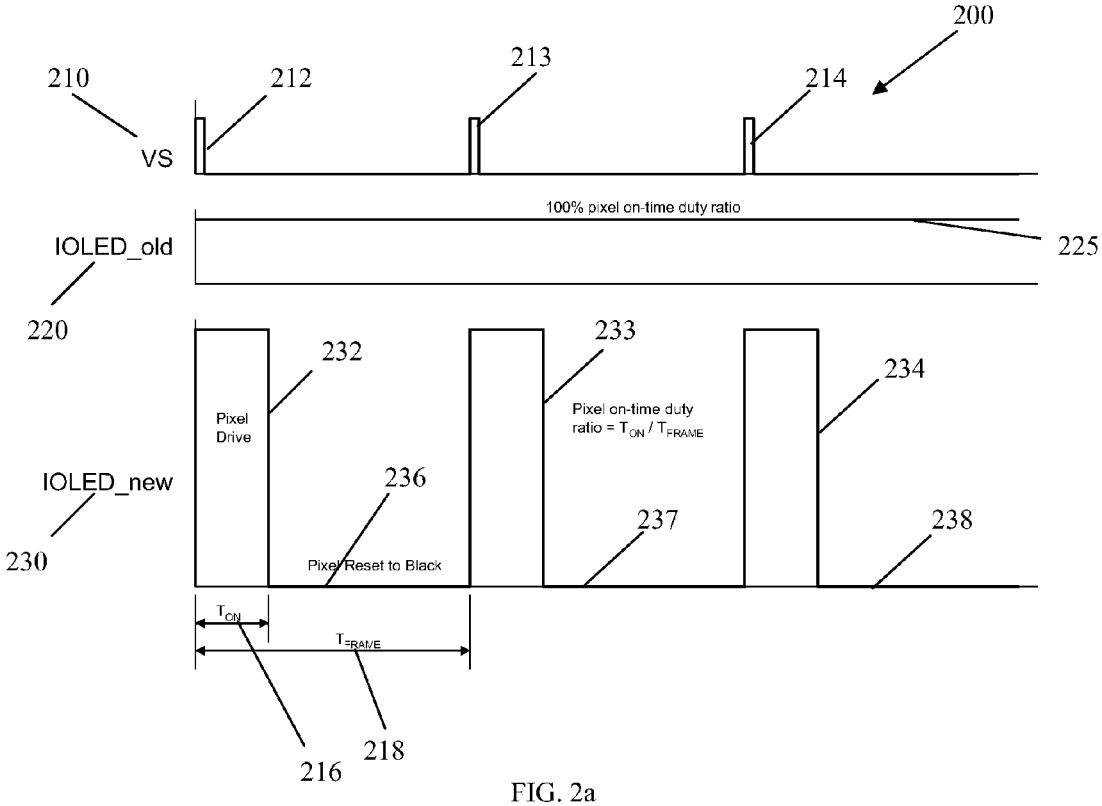
FIG. 2*a* is a timing diagram illustrating a standard OLED pixel drive signal compared to a pulse drive signal in accordance with an exemplary embodiment.

FIG. 2*a* illustrates timing diagram 200 including vertical sync (VS) pulse signal 210, standard OLED pixel drive signal 220 and pulse OLED pixel drive signal 230 in accordance with an exemplary embodiment. VS pulse signal 210 provides timing pulses 212, 213 and 214 indicating beginnings of frames. For instance, timing pulse 212 begins frame duration 218, which is illustrated in the graph of pulse OLED pixel drive signal 230. In a conventional pixel drive system, all of the rows are rewritten during a frame and are held at a constant voltage or current until rewritten in the next frame. For instance, row 1 of a pixel array may be written immediately after pulse 212 in frame duration 218 and may be rewritten immediately after pulse 213, and subsequently rewritten again after pulse 214. Standard OLED pixel drive signal 220 illustrates the conventional pixel drive scheme for conventional signal 225. In this case, the OLED pixel or sub-pixel driven according to this conventional scheme is always being energized. Alternatively, a conventional OLED drive signal may vary in intensity when rewritten in each frame, i.e., at regular intervals after each pulse 212, 213 and 214. In this case, the conventional OLED would still be constantly energized (except when the pixel is dark or black due to the signal being dark for that pixel or sub-pixel), but at different levels. The reprogramming of an individual OLED pixel or sub-pixel would occur at regular intervals after a VS pulse according to the row number of the OLED pixel or sub-pixel.

Pulse OLED pixel drive signal 230 illustrates a pixel drive signal according to an exemplary embodiment that is synchronized with VS pulse signal 210, and is therefore energized immediately after, or at the same time as, VS pulse signal 210. Alternatively, as discussed above, a pulse OLED pixel drive signal may be energized at regular intervals after VS pulse signal 210. Pixel drive signal 232 represents the signal for an OLED pixel or sub-pixel for frame duration 218 following VS pulse signal 210. Pixel drive signal 232 has a pulse duration 216, which is less than frame duration 218. Consequently, the pixel drive signal 232 has a greater intensity (i.e., an increased luminance) relative to conventional signal 225 so that an average luminance of a pixel driven by pixel drive signal 232 over frame duration 218 is equal to an average luminance of a pixel driven by conventional signal 225 over frame duration 218. After pulse duration 216, the OLED pixel or sub-pixel is reset to black for black period 236.

Pixel drive signal 233 represents the signal for an OLED pixel or sub-pixel for a frame duration following VS pulse signal 213. Pixel drive signal 233 has a pulse duration equal to pulse duration 216, which is less than frame duration 218, and consequently has a greater intensity relative to conventional signal 225. An average luminance of a pixel driven by pixel drive signal 233 over the frame duration is equal to an average luminance of a pixel driven by conventional signal 225 over the frame duration. After the pulse duration, the OLED pixel or sub-pixel is reset to black for black period 237. Similarly, pixel drive signal 234 represents the signal for an OLED pixel or sub-pixel for a frame duration following VS pulse signal 214. Pixel drive signal 234 has a pulse duration less than frame duration 218, and consequently has a greater intensity relative to conventional signal 225. An average luminance of a pixel driven by pixel drive signal 234 over the frame duration is equal to an average luminance of a pixel driven by conventional signal 225 over the frame duration. After the pulse duration, the OLED pixel or sub-pixel is reset to black for black period 238.

Figure 2B:
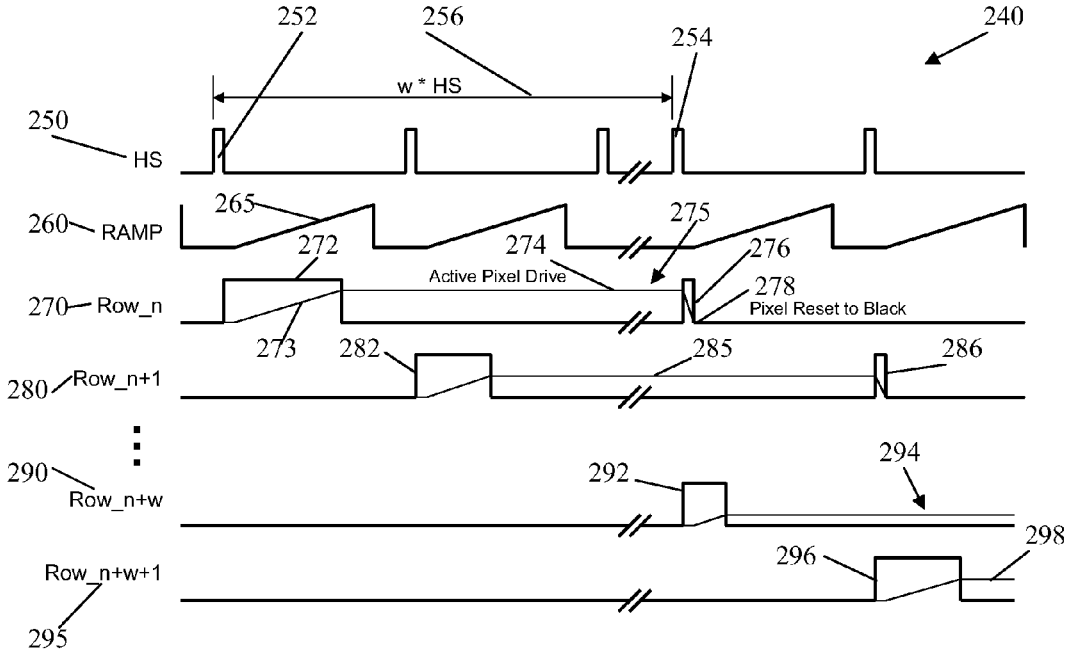
FIG. 2*b* is a timing diagram showing signals for different rows of an OLED array using a pulse drive in accordance with an exemplary embodiment.

A timing diagram for implementing a pulse mode drive, for example in an SXGA, is shown in FIG. 2*b*. In summary, a pixel in row_n is programmed to a current level during the first line period shown. The pixel will stay energized at this level until it is reset to black after a number of horizontal sync (HS) cycles, the number being designated as "w". Each row of pixels will also be reset following a number (w) of HS cycles after programming. A row of pixels is reset to black according to the present innovation by activating it at the beginning of a ramp cycle and switching it off before the ramp rises above zero volts. In this manner, all the pixels in the row will hold a black level until refreshed. The number (w) of HS cycles at which a row is reset to black after programming may be determined by testing, and may be adjustable. A luminance necessary to compensate for the diminished luminance during the reset period may be adjusted by a standard luminance adjustment, either automatically or manually.

FIG. 2*b* is timing diagram 240 for different rows of an OLED array using a pulse drive in accordance with an exemplary embodiment. FIG. 2*b* illustrates timing diagram 240 including horizontal sync (HS) pulse signal 250, ramp signal 260, row_n signal 270, row_n+1 signal 280, row_n+w signal 290, and row_n+w+1 signal 295 in accordance with an exemplary embodiment. HS pulse signal 250 provides timing pulses 252 and 254, among others, indicating that a new row is being written. Timing pulses 252 and 254, and the others, may be a short square pulse initiating the writing cycle. Ramp signal 260 may include ramp pulse 265, among others, which may start a short period (sometimes called the blanking period) after the end of timing pulse 252. Ramp pulse 265 may linearly increase to a maximum value, which may correspond to a maximum intensity for the OLED pixel. Each of row_n signal 270, row_n+1 signal 280, row_n+w signal 290, and row_n+w+1 signal 295 may be square wave signals having a high value and a low value. The length of each of the square waves (i.e., the time at which the signal is high) may be a linear function of an intensity defined by the corresponding digital video signal. Each of row_n signal 270, row_n+1 signal 280, row_n+w signal 290, and row_n+w+1 signal 295 may all correspond to a particular column of pixels in the respective identified rows. There would be a number of the row_n signals equal to the number of columns in the array, all starting at the same time as the row_n signal. The length of each square waves being at a high level may be determined by a binary digital signal in combination with a clock signal. The square wave of a row_n signal may provide a window to the periodic ramp signal 260. In particular, square wave 272 of row_n signal 270 may provide a window to ramp pulse 265 of ramp signal 260, thereby providing ramping portion 273 of active pixel signal 275, which is shown superimposed on row_n signal 270. Active pixel signal 275 ramps up according to ramp pulse 265 while square wave 272 is high and then holds the final, highest value of ramp pulse 265 upon the end of square wave 272, or in other words, when row_n signal 270 goes low. Active pixel signal 275 then maintains a substantially constant value, as supported by capacitive elements in the drive circuit, during hold period 274.

In a conventional system, active pixel signal 275 would remain at this substantially constant value until rewritten, namely after the writing of the frame is finished and n−1 rows of the next frame are written, namely frame duration 218 as shown in FIG. 2*a*. However, in the exemplary embodiment, the pixel associated with the row_n signal is reset to black after a period less than a frame, namely pulse duration 216 as shown in FIG. 2*a*. In particular, after a number of HS signals equal to w, where w is less than the number of rows in the array, row_n signal 270 includes reset pulse 276, which may be substantially similar or identical to timing pulse 254. Reset pulse 276 causes active pixel signal 275 to reset to black by discharging any capacitive elements in the driving circuit for the associated pixel. This resetting to black may also be referred to as grounding the drive signal. The pixel resetting to black is done by applying a zero volt drive signal to the pixel for a portion of the blanking period.

In this manner, the pixel associated with row_n signal 270 is black for a period during each frame duration 218, and therefore may have an opportunity to cool, which may have a beneficial impact on the life cycle and characteristics of the pixel. Consequently, the brightness of the pixel may have to be increased, which may be achieved by a standard adjustment of the brightness, which may be accomplished by increasing the time at which square wave 272 is high or by changing the rate of increase of the ramp pulses of ramp signal 260. The number w, which represents an integer value less than the number of rows in the array, may be determined by experimentation, and may be any of 10%, 20%, 40%, 50% or 80% of a number of rows of an array, and in particular, may be any integer number from one to the number of rows minus one.

Row_n+1 signal 280 may provide a window to a next ramp pulse of ramp signal 260, thereby providing a ramping portion to active pixel signal 285, which is shown superimposed on row_n+1 signal 280. Active pixel signal 285 ramps up according to the ramp pulse while square wave 282 is high and then holds the final, highest value of the ramp pulse upon the end of square wave 282 (i.e., when row_n+1 signal 280 goes low). Active pixel signal 285 then maintains a substantially constant value, as supported by capacitive elements in the drive circuit, until reset pulse 286 causes active pixel signal 285 to reset to black.

Row_n+w signal 290 may provide a window to a later ramp pulse of ramp signal 260, thereby providing a ramping portion to active pixel signal 294, which is shown superimposed on row_n+w signal 290. Active pixel signal 294 ramps up according to the ramp pulse while square wave 292 is high and then holds the final, highest value of the ramp pulse upon the end of square wave 292 (i.e., when row_n+w signal 290 goes low). Active pixel signal 294 then maintains a substantially constant value until a reset pulse causes active pixel signal 294 to reset to black.

Row_n+w+1 signal 295 may provide a window to a later ramp pulse of ramp signal 260, thereby providing a ramping portion to active pixel signal 298, which is shown superimposed on row_n+w+1 signal 295. Active pixel signal 298 ramps up according to the ramp pulse while square wave 296 is high and then holds the final, highest value of the ramp pulse upon the end of square wave 296 (i.e., when row_n+w+1 signal 296 goes low). Active pixel signal 296 then maintains a substantially constant value until a reset pulse causes active pixel signal 296 to reset to black.

Figure 3:
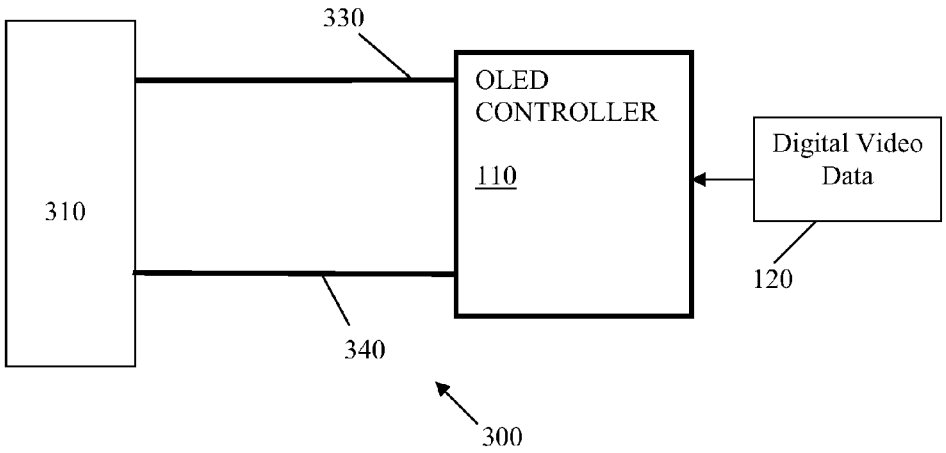
FIG. 3 is a schematic view of an OLED pixel including an OLED controller and a pixel in accordance with an exemplary embodiment.

FIG. 3 is a schematic view of OLED pixel (or sub-pixel) system 300 including OLED controller 110 and pixel 310 in accordance with an exemplary embodiment. OLED controller 110 receives digital video data 120 and processes the data to provide a signal to pixel 310 according to the discussion above. OLED controller 110 processes digital video data 120 into an analog signal that drives pixel 310. The analog signal may be a voltage or a current. Line 330 from OLED controller 110 may couple to an anode of pixel 310 and line 340 from OLED controller 110 may couple to a cathode of pixel 310. Alternatively, line 330 from OLED controller 110 may couple to a cathode of pixel 310 and line 340 from OLED controller 110 may couple to an anode of pixel 310. Pixel 310 may be a white OLED pixel or sub-pixel, with or without a color filter. Alternatively, pixel 310 may have an emissive layer that emits colored light when energized. Pixel 310 may be a sub-pixel paired with one or more other sub-pixels to form a pixel. Each of the sub-pixels may have a corresponding primary color output, for instance red, green and blue, which may be due to the emissive layer properties of the particular sub-pixel, a filter layer arranged on a surface of the sub-pixel, or both.

Figure 4:
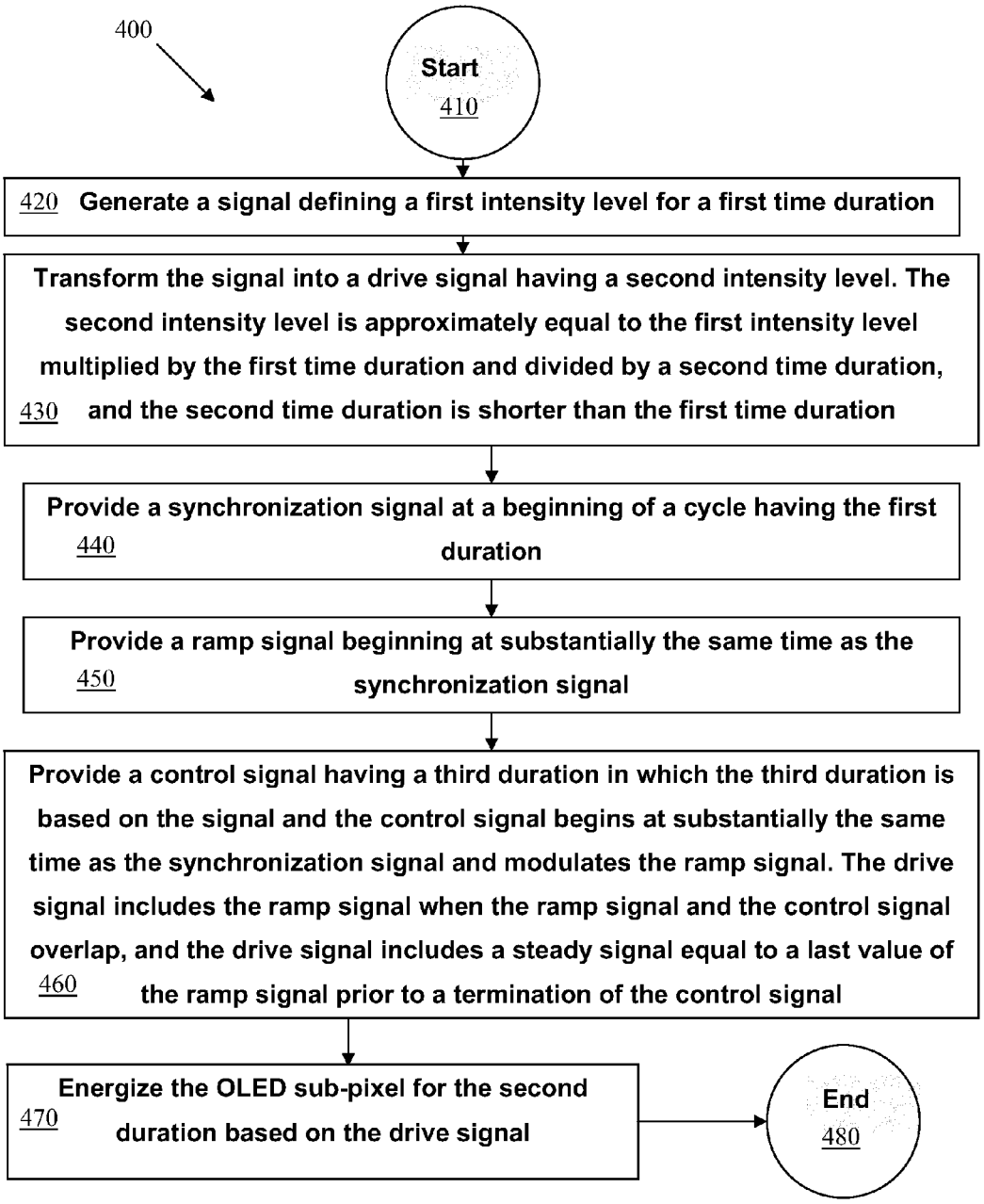
FIG. 4 illustrates a method according to an exemplary embodiment.

FIG. 4 illustrates method 400 according to an exemplary embodiment. Method 400 starts at start circle 410 and proceeds to operation 420, which indicates to generate a signal defining a first intensity level for a first time duration. From operation 420 the flow in method 400 proceeds to operation 430, which indicates to transform the signal into a drive signal having a second intensity level. The second intensity level is approximately equal to the first intensity level multiplied by the first time duration and divided by a second time duration, and the second time duration is shorter than the first time duration. From operation 430 the flow in method 400 proceeds to operation 440, which indicates to provide a synchronization signal at a beginning of a cycle having the first duration. From operation 440 the flow in method 400 proceeds to operation 450, which indicates to provide a ramp signal beginning at substantially the same time as the synchronization signal. From operation 450 the flow in method 400 proceeds to operation 460, which indicates to provide a control signal having a third duration, in which the third duration is based on the signal and the control signal begins at substantially the same time as the synchronization signal and modulates the ramp signal. The drive signal includes the ramp signal when the ramp signal and the control signal overlap, and the drive signal includes a steady signal equal to a last value of the ramp signal prior to a termination of the control signal. From operation 460 the flow in method 400 proceeds to operation 470, which indicates to energize the OLED pixel for the second duration based on the drive signal. From operation 470, the flow proceeds to end circle 480.

Figure 5:
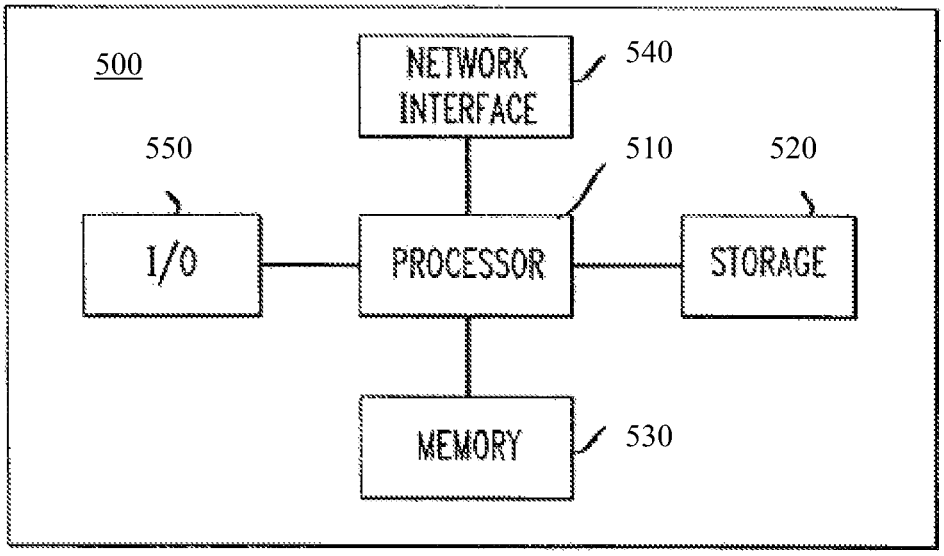
FIG. 5 illustrates a computer system according to an exemplary embodiment.

FIG. 5 illustrates a computer system according to an exemplary embodiment. Computer 500 can, for example, operate OLED pixel array system 100, may provide digital video data 120, or may be OLED controller 110. Additionally, computer 500 can perform the steps described above (e.g., with respect to FIG. 4). Computer 500 contains processor 510 which controls the operation of computer 500 by executing computer program instructions which define such operation, and which may be stored on a computer-readable recording medium. The computer program instructions may be stored in storage 520 (e.g., a magnetic disk, a database) and loaded into memory 530 when execution of the computer program instructions is desired. Thus, the computer operation will be defined by computer program instructions stored in memory 530 and/or storage 520 and computer 500 will be controlled by processor 510 executing the computer program instructions. Computer 500 also includes one or more network interfaces 540 for communicating with other devices, for example other computers, servers, or websites. Network interface 540 may, for example, be a local network, a wireless network, an intranet, or the Internet. Computer 500 also includes input/output 550, which represents devices which allow for user interaction with the computer 500 (e.g., display, keyboard, mouse, speakers, buttons, webcams, etc.). One skilled in the art will recognize that an implementation of an actual computer will contain other components as well, and that FIG. 5 is a high level representation of some of the components of such a computer for illustrative purposes.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

We claim:

1. A method for driving an organic light emitting diode (OLED) pixel comprising:

receiving a first control signal corresponding to a first time duration;

energizing said OLED pixel for a second time duration shorter than said first time duration; and setting said OLED pixel to black after said second time duration until an end of said first time duration, wherein said first control signal defines a first intensity level for said OLED pixel for said first time duration, and further comprising:

transforming said first control signal into a drive signal having a second intensity level, said second intensity level being approximately equal to said first intensity level multiplied by said first time duration and divided by said second time duration, wherein said step of transforming comprises:

providing a synchronization signal at a beginning of a cycle having said first time duration;

providing a ramp signal beginning at substantially a same time as said synchronization signal; and providing a second control signal for modulating the ramp signal and having a third time duration, said third time duration being based on the first intensity level of said first control signal, said second control signal beginning at substantially said same time as said synchronization signal;

wherein said drive signal comprises said ramp signal when said second control signal is high, and, when said second control signal is low, said drive signal is substantially constant at a value of said ramp signal at a transition of said second control signal front high to low, wherein said step of transforming further comprises setting the drive signal to substantially zero with another synchronization signal a after said second time duration, wherein:

said first control signal associated with a first frame period, said first frame period being one of immediately consecutive flame periods, each frame period having a frame duration substantially identical to said first time duration;

said synchronization signal is periodic and a first number of said synchronization signals occurs during any frame period, said first number being three or more; and said OLED pixel set to black in response to a second one of said synchronization signals, said second on of said synchronization signals following said first one of said synchronization signals by a second number of synchronization signals, said second number being less than said first number.

2. The method of claim 1, wherein setting of said drive signal to substantially zero comprises discharging a capacitive element in a drive circuit that holds said drive signal.

3. The method of claim 1, wherein:

said synchronization signal is periodic and corresponds to a horizontal synchronization signal;

said first time duration comprises a frame in which said horizontal synchronization signal pulses once for each row in a display; and said method is performed for other OLED pixels in a same row as said OLED pixel using said synchronization signal.

4. The method of claim 1, wherein;

said synchronization signal is periodic and corresponds to a vertical synchronization signal;

said first time duration comprises a frame in which said vertical synchronization signal pulses once for each column in a display; and said method is performed for other OLED pixels in a same column as said OLED pixel using said synchronization signal.

5. The method of claim 1, wherein:

said second intensity level is approximately equal to between 5 and 10 times said first intensity; and said second time duration is approximately equal to between 10 and 20 percent of said first time duration.

6. The method of claim 1, wherein:

said first intensity level and said second intensity level are measured in candela per square meter; and said first time duration and said second time duration are measured in milliseconds.

7. An organic light emitting diode (OLED) pixel system comprising:

means for receiving a first control signal corresponding to a first time duration;

means for energizing said OLED pixel for a second time duration shorter than said first time duration; and means for setting said OLED pixel to black after said second time duration until an end of said first time duration, wherein said first control signal defines a first intensity level fin said OLED pixel for said first time duration, and further comprising;

means for transforming said first control signal into a drive signal having a second intensity level, said second intensity level being approximately equal to said first intensity level of multiplied by said first time duration and divided by said second time duration, wherein said transforming means comprises:

means for providing a synchronization signal at a beginning of a cycle having said first time duration;

means for providing as ramp signal beginning at substantially a same time as said synchronization signal; and means for providing a second control signal for modulating the ramp signal and having a third time duration, said third time duration being used on the first intensity level of said first control signal, said second control signal beginning it substantially said same time as said synchronization signal;

wherein said drive signal comprises said ramp signal when said second control signal is high, and when said second control signal is low, said drive signal is substantially constant at a value of said ramp signal at a transition of said second control signal from high to low, wherein said transforming means further comprises means or setting the drive signal to substantially zero with another synchronization signal after said second time duration, wherein:

said first control signal is associated with a first frame period, said first frame period being one of immediately consecutive frame periods, each frame period having a frame duration substantially identical to said first time duration;

said synchronization signal is periodic and a first number of said synchronization signals occurs during any frame period, said first number being three or more; and said OLED pixel is set to black in response to a second one of said synchronization signals, said second one of said synchronization signals following said one of said synchronization signals by a second number of synchronization signals, said second number being less than said first number.

8. The OLED pixel system of claim 7, wherein setting means comprises means for discharging a capacitive element in a drive circuit that holds said drive signal.

9. The OLED pixel system of claim 7, wherein:

said synchronization signal is periodic and corresponds to a horizontal synchronization signal;

said first time duration comprises a frame in which said horizontal synchronization signal pulses once for each row in a display; and said OLED pixel system comprises other OLED pixels in a same row as said OLED pixel using said synchronization signal.

10. The OLED pixel system of claim 7, wherein;

said synchronization signal is periodic and corresponds to a vertical synchronization signal;

said first time duration comprises a frame in which said vertical synchronization signal pulses once for each column in a display; and said OLED pixel system comprises other OLED pixels in a same column as said OLED pixel using said synchronization signal.

11. A non-transitory computer-readable medium having stored thereon computer-executable instructions, the computer-executable instructions causing a processor to perform a method when executed, the method for driving an organic light emitting diode (OLED) pixel, the method comprising:

receiving a first control signal corresponding to a first time duration;

energizing said OLED pixel for a second time duration shorter than said first time duration; and setting said OLED pixel to black after said second time duration until an end of said first time duration, wherein said first control signal defines a first intensity level for said OLED pixel for said first time duration, and further comprising:

transforming said first control signal into a drive signal having a second intensity level, said second intensity level being approximately equal to said first intensity level multiplied by said first time duration and divided by said second time duration, wherein said step of transforming comprises:

providing a synchronization signal at a beginning of a cycle having said first time duration;

providing ramp signal beginning at substantially a same time as said synchronization signal; and providing a second control signal for modulating the ramp signal and having a third time duration, said third time duration being based on the first intensity level of said first control signal, said second control signal beginning substantially said same time as said synchronization signal;

wherein said drive signal comprises said ramp signal when said second control signal is high, and, when said second control signal is low, said drive signal is substantially constant at a value of said ramp signal at a transition of said second control signal from high to low, wherein said step of transforming farther comprises setting the drive signal to substantially zero with another synchronization signal after said second time duration, wherein:

said first control signal is associated with a first frame period, said first frame period being one of immediately consecutive frame periods, each frame period having a frame duration substantially identical to said first time duration;

said synchronization signal is periodic and a first number of said synchronization signals occurs during any frame period, said first number being three or more; and said OLED pixel is set to black in response to a second one of said synchronization signals, said second one of said synchronization signals following said first one of said synchronization signals by a second number of synchronization signals, said second number being less than said first number.

* * * * *